United States Patent [19]

Wulms

[11] 4,171,480

[45] Oct. 16, 1979

[54] IMAGE INTENSIFIER TUBE

[75] Inventor: Christiaan J. G. H. Wulms, Eindhoven, Netherlands

[73] Assignee: U.S. Philips Corporation, New York, N.Y.

[21] Appl. No.: 867,010

[22] Filed: Jan. 5, 1978

[30] Foreign Application Priority Data

Mar. 3, 1977 [NL] Netherlands ..... 7702261

[51] Int. Cl.[2] ..... H01J 31/50

[52] U.S. Cl. ..... 250/213 VT; 313/102

[58] Field of Search ..... 250/203 CT, 213 VT, 250/239; 313/94, 102

[56] References Cited

U.S. PATENT DOCUMENTS 3,304,455 2/1967 Mesta ..... 250/213 VT 3,356,851 12/1967 Carlson ..... 250/213 VT 3,916,240 10/1975 Cuelenaere et al. ..... 313/102

*Primary Examiner*—David C. Nelms

[57] ABSTRACT

An image intensifier comprises an image intensifier tube which is provided with a mounting ring, having a reference face which occupies a fixed position relative to an entrance window, even in the case of temperature variations. The image intensifier tube is accommodated, with intermediate resilient material, in an envelope having a mounting face for mounting an entrance optical system to be added. When the addition is mounted, the reference face bears against the entrance optical system under spring force exerted by the resilient material and the free entrance window occupies an optimally fixed position.

6 Claims, 1 Drawing Figure

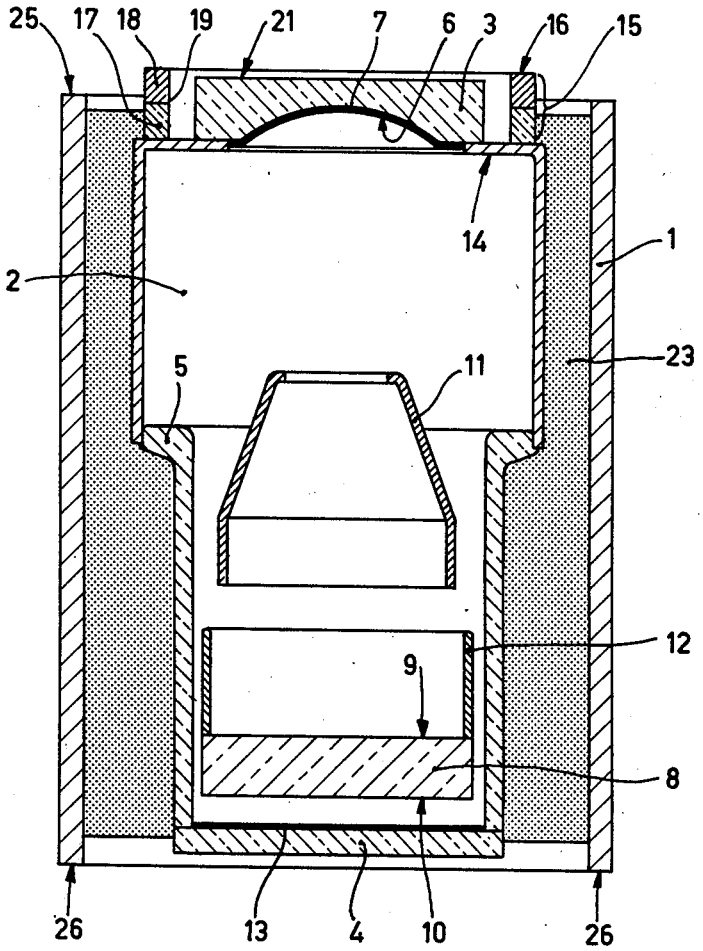
25
17
18
19
21
7
6
3
16
15
14
1
2
23
5
11
12
9
8
26
13
4
10
26

IMAGE INTENSIFIER TUBE

The invention relates to an image intensifier tube, comprising an entrance window with a photo-cathode, an electron-optical system and an exit window.

An image intensifier tube of this kind is known from U.S. Pat. No. 3,660,668. In an image intensifier tube described therein, shocks or temperature variations are liable to cause deviations in the positioning of the tube with respect to, for example, an entrance optical system, so that correct image formation can be disturbed.

The invention has for its object to mitigate these drawbacks; to this end, an image intensifier tube of the described kind is characterized in accordance with the invention in that the tube is provided with an upright ring which is situated adjacent the entrance window and an end face of which occupies an acurately defined position with respect to the entrance window, the thermal expansion of the entrance window and the ring being adapted to each other for minimum displacement relative to each other, the image intensifier tube being resiliently mounted in an envelope.

Due to the mounting in accordance with the invention, a shockproof tube construction is obtained in a simple manner and derangement of the tube by temperature variations is mitigated to a substantial degree.

In a preferred embodiment in accordance with the invention, the ring consists of a glassy melting ring on which a metal mounting ring is arranged. The axial dimensions of the entrance window and of the combined rings and the thermal expansion thereof are optimally adapted to each other.

In a further preferred embodiment, the image intensifier tube is resiliently arranged in an envelope which is provided with a mounting abutment face on the entrance window side.

Some preferred embodiments in accordance with the invention will be described in detail hereinafter with reference to the accompanying diagrammatic drawing.

The drawing shows an image intensifier tube in accordance with the invention, comprising an upright ring with an abutment face.

An image intensifier tube in accordance with the invention, as shown in the FIGURE, comprises an envelope 1, an image intensifier tube 2 with a preferably fiber-optic entrance window 3, an exit window 4, and a cylindrical tube wall 5. The entrance window is provided with a photocathode 7 on its inner side 6 which is preferably concave. Opposite the photocathode there is provided a channel amplifier plate 8, comprising an entrance face 9 and an exit face 10. Between the photocathode and the channel plate there are provided an electrode 11 and an electrode 12 for forming the image of the photocathode on the channel plate or on an exit window. A preferred embodiment of the electron-optical zystem of an image intensifier tube is described in application Ser. No. 861,723, filed Dec. 19, 1977. It is to be noted that commonly used photocathodes have an electrical conductivity so that they can be considered as an electrode in the electron-optical system. If this is not the case, an additional electrode which transmits the radiation to be measured can be provided. The exit window 4 is provided on its inner side with a luminescent layer 13.

In an image intensifier tube which does not include a channel plate window, the luminescent layer takes the place of the channel plate face 9, disregarding a possibly modified electron-optical system.

A ring 15 is provided on a wall portion 14 of the tube wall 5. A ring of this kind can be provided, for example, by fusion or by sealing. Axially viewed, the ring 15 is provided with an accurately ground end face 16. In the embodiment shown, the ring consists of two portions, i.e. a glassy melting ring 17 and a preferably metal ring 18. The ring 17 in this case also serves for electrical insulation of the photocathode. The metal ring 18 is made, for example, of fernico, like the tube jacket, and is connected to the ring 17 by way of a glass-to-metal connection or a seal 19. The entrance window 3, also being connected to the wall portion 14, is provided with an entrance face 21 on the outer side of the tube, said face and the ring face 16 being situated exactly in one plane, or said entrance face being shifted over an accurately defined, short distance with respect thereto. By suitable proportioning notably of the axial dimensions of the window and the ring, and by suitable choice of the material in view of thermal expansion, it is achieved that the positions of the surface 21 and the surface 16 with respect to each other do not change in the case of temperature variations. Due to the reference to the surface 16, the entrance window surface will always remain at a predetermined distance from, for example, an entrance optical system added to the window tube during operation. If an image to be intensified is not projected onto the entrance surface by the entrance optical system, as is usual in the case of a fibre-optical window, but rather on the photocathode itself, like in the case of a normal glass window, the position of the photocathode is fixed in the same manner.

The image intensifier tube 2 is connected to the envelope 1, preferably with an intermediate resilient material 23. In a practical tube, this material consists of electrically insulating rubber and fills the entire intermediate space, possibly with the exception of recesses for accommodating at least a part of a power supply circuit (not shown). The mounting of further parts such as, for example, an entrance optical system can now be realized by mounting in a pressing manner, the reference face 16 acting as an abutment face which is pressed against the element to be added by the resilience of the rubber, so that the entrance face 21 of the entrance window occupies the desired position. Pressure is produced, for example, by the pressing of an end face 26 of the envelope 1. This method of mounting eliminates damaging of the entrance window and this window can be mounted as desired at a very small distance or at an accurately defined larger distance. Axial length variations of the entrance window are taken up by the ring, so that the window entrance face always remains in position with the photo-cathode face. Even though usually less necessary, in some cases corresponding mounting means can be provided on the exit side of the tube, for example, in the case of recording by way of a television camera tube.

An image intensifier in accordance with the invention is particularly suitable for use in night viewers and for detecting images having a very low radiation level. By adaptation of the photocathode, notably of a scintellation layer added thereto, the tube can be adapted to different kinds of radiation.

Even though the invention has been described particularly with reference to a tube comprising a fiber-optical entrance window and a channel plate amplifier, neither the one nor the other is of essential importance for the invention, and the invention is not restricted thereto. A fibre-optical extrance window offers the advantage that reference can be made to the flat entrance face, because an input image is projected thereon, and the supporting surface for the photocathode can be adapted to optimum imaging conditions for the electron-optical system without taking into account the geometry of the image plane of the entrance optical system. When use is made of a homogeneous entrance window, optimum adaptation of the exit image plane of the entrance optical system to the photocathode plane is desirable, and both conditions may then be contradictory. In the case of these entrance windows, it must be ensured first of all that the plane of the photocathode remains fixed with respect to the reference face in the case of temperature variations. The position of the mounting face with respect to the reference face is codetermined by the construction of the part to be added.

What is claimed is:

1. An image intensifier tube, comprising an inner envelope having an entrance window, a photocathode, an electron-optical system and an exit window, an upright ring supported by the inner envelope adjacent the entrance window and having an end face accurately positioned a given distance from an entrance face of the entrance window, the thermal expansion of entrance window and ring being adapted to each other for minimum displacement relative to each other, and means resiliently to mount the inner envelope of the image intensifier tube within an outer envelope.

2. An image intensifier tube as claimed in claim 1, wherein the entrance window is a fiber-optic window the axial dimensions of which and of the upright ring and the thermal expansion coefficients thereof are chosen so that a minimum variation occurs in the positions of the ring end face and the entrance window face with respect to each other in the case of temperature variations.

3. An image intensifier tube as claimed in claim 2, wherein the envelope comprises a wall which defines a mounting face adjacent the entrance window, said mounting face being situated to be moveable away from the entrance face of the entrance window.

4. An image intensifier tube as claimed in claim 3, wherein the upright ring consists of a glassy portion which is connected to the tube and a metal portion which supports the accurately defined end face.

5. An image intensifier tube as claimed in claim 4, wherein an electrically insulating rubber is present between the image intensifier tube and the envelope.

6. An image intensifier tube as claimed in claim 5, wherein in the insulating rubber spaces are provided for parts of a power supply circuit for the tube.

* * * * *

UNITED STATES PATENT AND TRADEMARK OFFICE

CERTIFICATE OF CORRECTION

PATENT NO. : 4,171,480

DATED : Oct. 16, 1979

INVENTOR(S) : CHRISTIAAN J.G.H. WULMS

It is certified that error appears in the above-identified patent and that said Letters Patent are hereby corrected as shown below:

Col. 1, lines 23, 35 and 45, after "an" insert --outer--;
line 47, change "a" to --an inner envelope--;
Col. 2, lines 34 and 48, after "the" insert --outer--;
line 54, after "face" insert --The outer envelope 1 preferably has a mounting face 25 at the entrance window side, disposed slightly to the rear of and resiliently moveable with respect to the entrance face 21.--;
line 62, change "scintella" to --scintilla--;
Col. 3, line 2, change "fibre-optical" to --fiber-optic--;

Claim 3, line 2, after "the" insert --outer--;
line 4, after "be" insert --resiliently--;

Claim 5, line 3, before "envelope" insert --outer--.

Signed and Sealed this

*Nineteenth* Day of *February 1980*

[SEAL]

*Attest:*

SIDNEY A. DIAMOND

*Attesting Officer*

*Commissioner of Patents and Trademarks*